United States Patent [19]

House et al.

[11] 4,399,335

[45] Aug. 16, 1983

[54] SWITCH ACTUATOR ASSEMBLY

[75] Inventors: Ronnalee House; John Delaplane; Ronald G. Davis, all of Anderson, Ind.

[73] Assignee: General Motors Corporation, Detroit, Mich.

[21] Appl. No.: 289,788

[22] Filed: Aug. 3, 1981

[51] Int. Cl.[3] ..... H01H 19/54; H01H 21/80; H01H 51/08

[52] U.S. Cl. ..... 200/11 R; 200/17 R; 200/153 L; 335/72; 335/138

[58] Field of Search ..... 200/1 R, 4, 5 R, 11 R, 200/17, 18, 38, 47, 153 L, 175–180; 335/72, 75, 118, 121, 122, 125, 128, 138, 139, 185, 189

[56] References Cited

U.S. PATENT DOCUMENTS

| | | | |
|---|---|---|---|
| 1,680,416 | 8/1928 | Hodgkins | 335/181 |
| 2,564,246 | 8/1951 | Bourne | 335/181 |
| 2,760,026 | 8/1956 | Horlacher | 335/181 |
| 2,993,963 | 7/1961 | Beardow | 200/30 R |
| 3,233,066 | 2/1966 | Stoddard et al. | 335/114 |
| 3,546,401 | 12/1970 | Carlisle | 200/1 R |
| 3,689,820 | 9/1972 | Takegawa | 318/594 |
| 3,743,799 | 7/1973 | Cork et al. | 200/6 B |
| 3,931,483 | 1/1976 | Thompson | 200/1 R |
| 3,944,902 | 3/1976 | Lacorre et al. | 318/593 |
| 3,974,346 | 8/1976 | Keprda | 200/5 B |
| 3,995,206 | 11/1976 | Aronstein et al. | 318/593 |
| 4,021,714 | 5/1977 | Jones et al. | 318/594 |
| 4,264,791 | 4/1981 | Williams | 200/4 |
| 4,281,304 | 7/1981 | Koshman et al. | 335/139 X |
| 4,368,443 | 1/1983 | Koshman et al. | 335/138 |

FOREIGN PATENT DOCUMENTS

| | | |
|---|---|---|
| 681221 | 9/1939 | Fed. Rep. of Germany . |
| 1072895 | 6/1960 | Fed. Rep. of Germany . |
| 205062 | 5/1924 | United Kingdom . |
| 1196115 | 6/1970 | United Kingdom . |
| 2047964 | 12/1980 | United Kingdom . |

*Primary Examiner*—J. R. Scott
*Attorney, Agent, or Firm*—C. R. Meland

[57] ABSTRACT

An elongated unitary arm of a rigid material is tiltably mounted upon a rotor supported for rotation about a central axis and is spring force tilted in a first direction. This assembly is located in such a manner that the arm may be placed in register with any one of the operating tabs of a plurality of electrical load switches so mounted and oriented that the operating tabs extend toward the central axis to define a circle. Upon being placed in register with a switch operating tab, the arm is tilted in the opposite direction by the action of a solenoid actuated plunger.

5 Claims, 9 Drawing Figures

SWITCH ACTUATOR ASSEMBLY

BACKGROUND OF THE INVENTION

This invention is directed to a remote control unit switch actuator assembly that is capable of selectively operating each of a plurality of centrally located individual electrical load switches.

Disclosed and described in this specification is a switch actuator assembly for a remote control unit employing a plurality of conventional individual electrical load switches individually operated by the switch actuator assembly. The individual electrical load switches may be simple sliding contact type switches that provide high reliability, high current rating and low voltage drop. Each of these switches may be operated between one circuit condition and another circuit condition by an operating tab that is movable in two directions and are of the type that, once operated, remain in position until the reverse operation is performed. The individual electrical load switches are so mounted and oriented that the several operating tabs extend toward a central axis to define a circle substantially normal to the central axis and are operable in two opposite directions substantially in the direction of the central axis. The switch actuator assembly involves a step motor driven rotor, a switch actuator arm tiltably mounted upon the rotor and normally spring force tilted in a first direction in which the ends thereof on opposite sides on the axis of pivot are on respective operating sides of the switch operating tabs and having the ends thereof on opposite sides of the axis of pivot circumferentially offset from each other so that each may be brought into register with each switch operating tab at mutually exclusive angular positions and an electrical solenoid coil arranged to effect the tilting of the actuator arm in the opposite direction. With this arrangement, the end of the actuator arm normally tilted away from the rotor may operate any of the switch operating tabs substantially in the direction of the central axis toward the rotor and the other end of the actuator arm normally tilted toward the rotor may operate any of the switch operating tabs substantially in the direction of the central axis away from the rotor. To operate the operating tab of a selected individual electrical load switch in a direction toward the rotor, the end of the actuator arm tilted away from the rotor is brought into register with this operating tab and the solenoid coil is energized to tilt the actuator arm in the opposite direction to operate the operating tab with which it is in register. To operate the operating tab of a selected individual electrical load switch in a direction away from the rotor, the end of the actuator arm tilted toward the rotor is brought into register with this operating tab and the solenoid coil is energized to tilt the actuator arm in the opposite direction to operate the operating tab with which it is in register. The switch actuator assembly of this invention, therefore, has the desirable feature of the capability of operating any one of a plurality of centrally mounted electrical load switches.

With automotive applications in particular, a major improvement in the electrical load network may be realized by centrally controlling the several power switching operations near the load or battery at a location outside the passenger compartment. Such a system eliminates the requirement that the electrical power wiring for the several automotive load circuits such as head lamps, horn, ignition, cranking motors, turn signals and so forth be brought into the dash and instrument panel area. The remote control unit switch actuator assembly of this invention, therefore, is particularly advantageous with automotive applications in that it may operate a plurality of electricl load switches centrally mounted in a remote location out of the passenger compartment such as the engine compartment. So mounted, the wiring congestion in the instrument panel and dash area is significantly reduced for the reason that, with its use, most load circuits may be removed from this space.

It is an object of this invention to provide the switch actuator assembly of a remote control unit that is capable of effecting the operation of each of a plurality of centrally located individual electrical load switches.

It is another object of this invention to provide the switch actuator assembly of a remote control unit that is capable of effecting the operation of each of a plurality of individual electrical load switches having operating tabs extending toward a central axis to define a circle substantially normal to the central axis and movable generally axially in the direction of the central axis and includes a rotor arranged to be supported for rotation about the central axis that is registerable with any one of the plurality of switch operating tabs and arranged to support an elongated unitary arm.

It is another object of this invention to provide the switch actuator assembly of a remote control unit that is capable of effecting the operation of each of a plurality of individual electrical load switches having operating tabs extending toward a central axis to define a circle substantially normal to the central axis and movable generally axially in the direction of the central axis and includes a rotor mounted elongated unitary arm of a rigid material having a transverse arcuate portion defining a convex and a concave arcuate bearing surface substantially at its longitudinal center.

It is another object of this invention to provide the switch actuator assembly of a remote control unit that is capable of effecting the operation of each of a plurality of individual electrical load switches having operating tabs extending toward a central axis to define a circle substantially normal to the central axis and movable generally axially in the direction of the central axis and includes a rotor mounted elongated unitary arm of a rigid material that is characterized by a transverse arcuate portion defining a convex and a concave bearing surface substantially at the longitudinal center thereof; an elongated indentation on each side of the transverse arcuate portion and the extremities thereof on respective opposite sides of the transverse arcuate portion being circumferentially offset relative to each other.

It is another object of this invention to provide the switch actuator assembly of a remote control unit that is capable of effecting the operation of each of a plurality of individual electrical load switches having operating tabs extending toward a central axis to define a circle substantially normal to the central axis and movable generally axially in the direction of the central axis and includes a rotor mounted elongated unitary arm of a rigid material normally tilted in a first direction under the influence of an elongated unitary spring of a flat spring material characterized by a first reverse double arc section at one extremity thereof; a contiguous flat cantilever section; a contiguous intermediate section having the parallel edges thereof extending angularly therefrom; and a contiguous second reverse double arc section at the opposite extremity thereof formed to provide a terminating portion that intersects the plane of the intermediate section and is provided with two spaced shoulders lying in the same plane and extending toward the center line thereof.

In accordance with this invention, a remote control unit switch actuator assembly is provided wherein a rotatable elongated unitary arm is arranged to be placed in register with each of a plurality of operating tabs of electrical load switches that are so mounted and oriented that the operating tabs extend toward and are operable in the direction of a central axis.

For a better understanding of the present invention, together with additional objects, advantages and features thereof, reference is made to the following description and accompanying drawings in which:

DESCRIPTION OF THE PREFERRED EMBODIMENT

Figure 6:
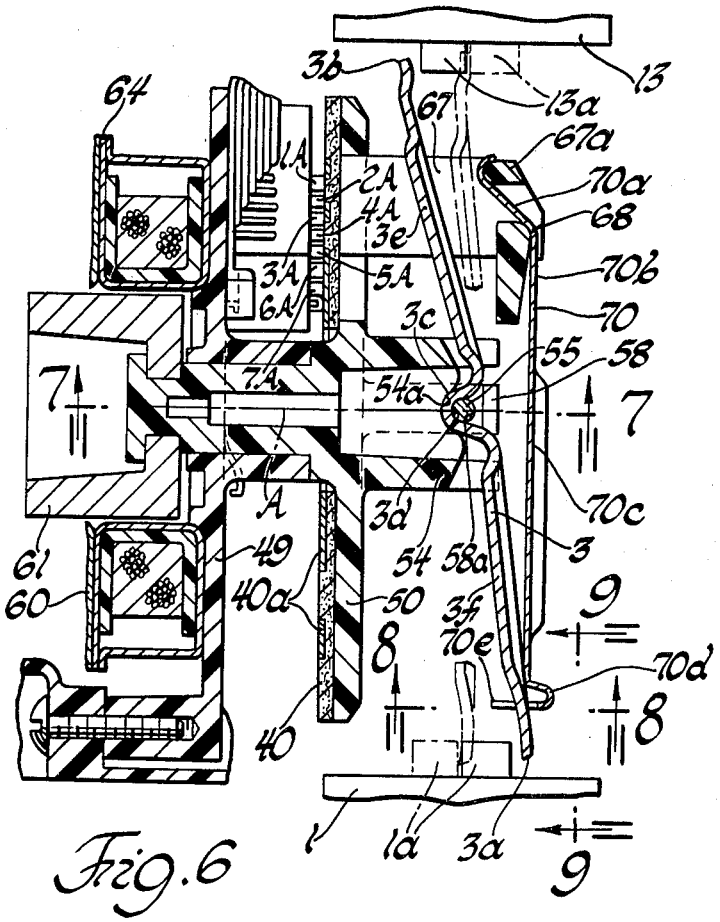
FIG. 6 is an elevation view in section of the switch actuator portion of FIG. 5 looking in the direction of the arrows 6—6.

As is best seen in FIG. 6, the rotatable switch actuator assembly of this invention includes (1) a rotor 50 supported for rotation about a central axis A and registerable with any one of a plurality of switch actuators movable in generally axial directions; (2) an elongated unitary arm 3 of a rigid material having a transverse arcuate portion defining convex 3*c* and concave 3*d* arcuate bearing surfaces substantially at its longitudinal center; (3) a support member 54 carried by rotor 50 that is substantially centered about and extends in the direction of central axis A and defines at least one arcuate bearing surface 54*a* having an axis that substantially intersects central axis A and accommodates convex bearing surface 3*c* of arm 3 whereby arm 3 is tiltably supported by rotor 50 about an axis of tilt; (4) a retaining pin 55 disposed within concave bearing surface 3*d* of arm 3; and (5) a pair of resiliently spreadable retaining pin accommodating members 57 and 58, FIG. 7, carried by rotor 50 and extending substantially in the direction of central axis A on opposite sides of support member 54 with each having a shoulder 57*a* and 58*a* extending toward central axis A at a location to overlay respective ends of retaining pin 55 to provide snap-in assembly thereof.

This switch actuator assembly will now be described in detail with reference to the remote control unit set forth in FIGS. 1–9, inclusive, of the drawing.

Figure 1:
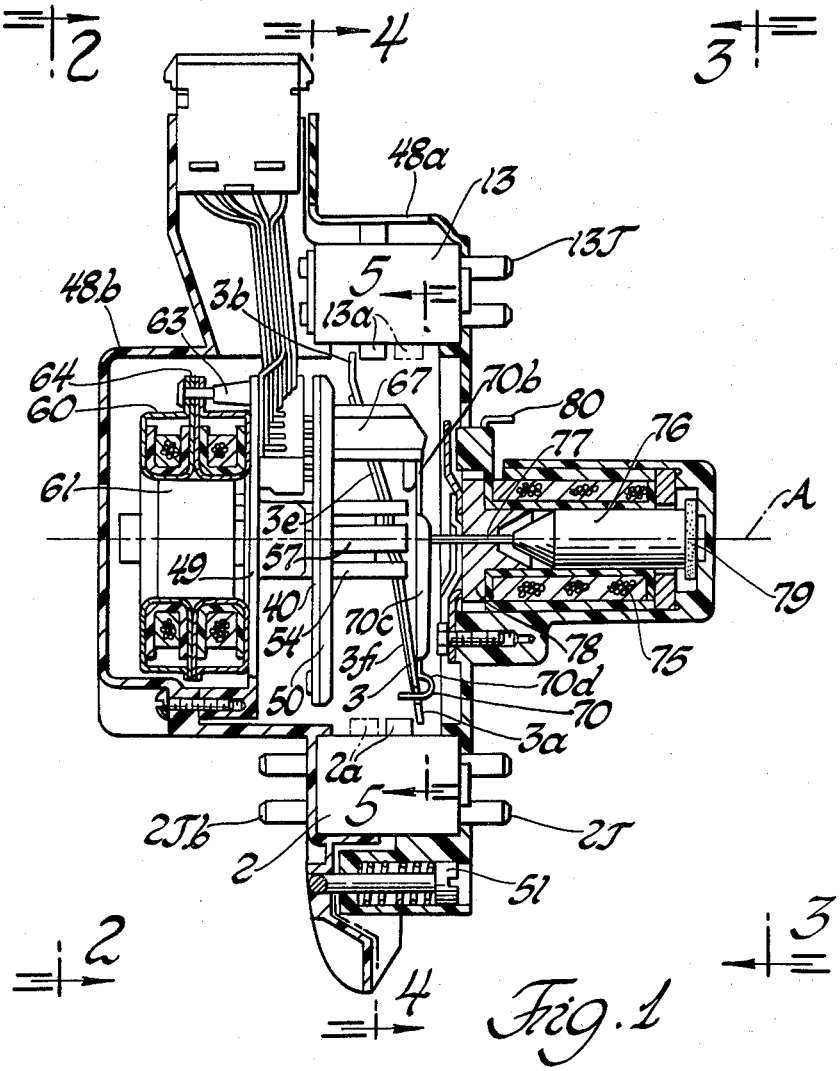
FIG. 1 is an elevation view partially in section of a remote control unit in which the switch actuator assembly of this invention is employed.
Figure 4:
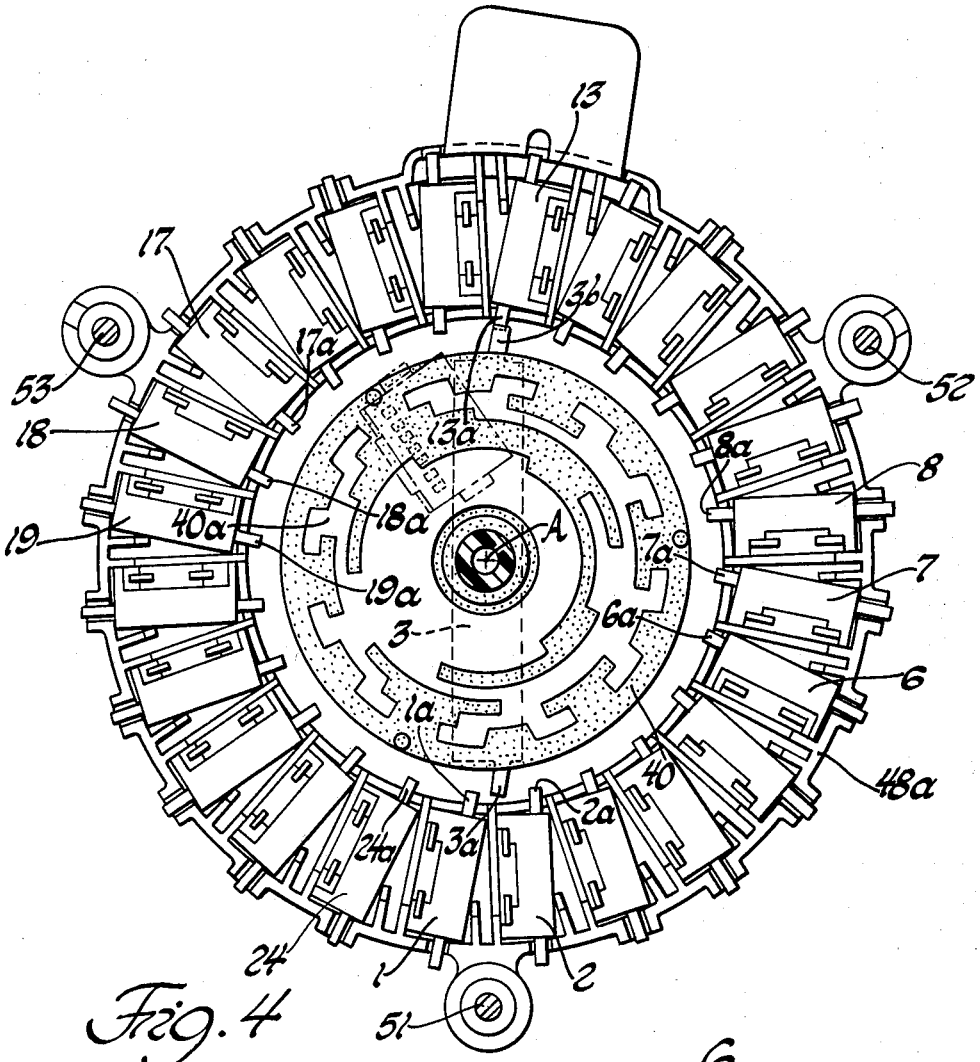
FIG. 4 is a section view of FIG. 1 taken along line 4—4 and looking in the direction of the arrows.
Figure 5:
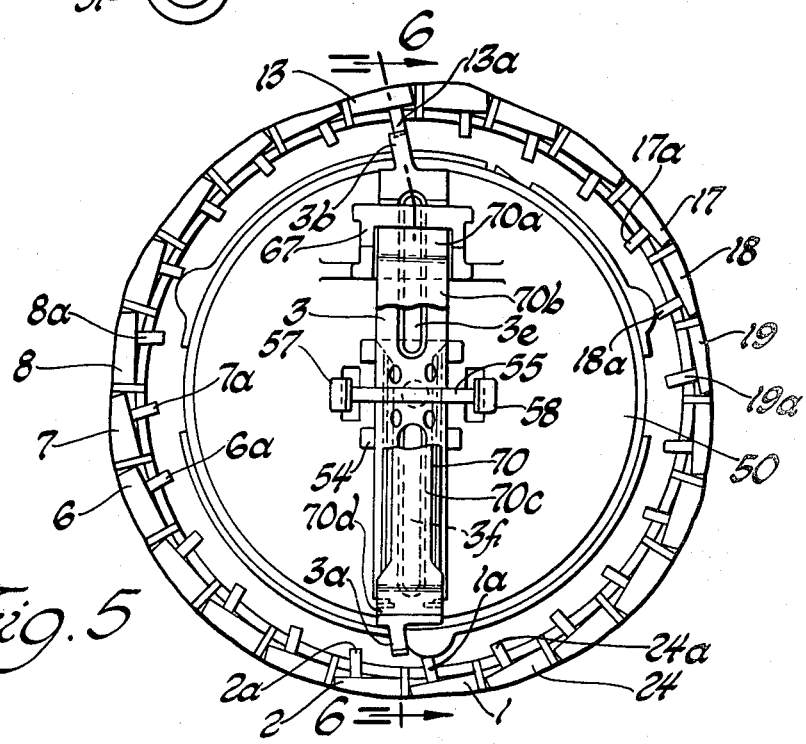
FIG. 5 is a partial section view of FIG. 1 taken along line 5—5 and looking in the direction of the arrows.

As is best seen in FIG. 1, a two-part housing 48*a* and 48*b* is designed to securely support a plurality of individual electrical switches in a circumferential arrangement. Both portions 48*a* and 48*b* may be made of an injection molded plastic material such as glass and mica-filled polyethylene terephthalate marketed by E. I. DuPont de Nemours & Co. of Wilmington, Delaware under the trade name "Rynite". The two portions 48*a* and 48*b* of the housing may be secured together by any suitable fastening arrangement such as spring latches 51, 52 and 53. Each of the individual electrical load switches may be of the conventional sliding contact type having an operating tab that is movable in two opposite directions to establish, respectively, one circuit condition or another circuit condition of the switch. Although there are twenty-four individual electrical load switches employed in this embodiment, since all of these switches are substantially physically identical, ten are referenced by the reference numerals 1, 2, 6, 7, 8, 13, 17, 18, 19 and 24 as is best seen in FIGS. 4 and 5. These twenty-four individual electrical load switches are so mounted and oriented that the operating tab of each extends toward central axis A to define a circle substantially normal to and concentric with central axis A and is movable substantially in the direction of central axis A between a common pair of planes substantially normal to central axis A to establish, respectively, one circuit condition or another circuit condition of the corresponding switch. This is best seen in FIG. 1 in which operating tab 13*a* of switch 13 is shown in solid lines and operating tab 2*a* of switch 2 is shown in dashed lines in the same first common plane and operating tab 13*a* of switch 13 is shown in dashed lines and operating tab 2*a* of switch 2 is shown in solid lines in the same second common place. Therefore, the individual electrical switch operating tabs are movable in generally axial directions substantially in the direction of central axis A between a common pair of planes substantially normal to central axis A.

Referring to FIG. 1, rotor 50 is located within the substantially cylindrical volume defined by the inboard face surfaces of the individual electrical switches and is supported for rotation substantially about central axis A in a plane substantially normal to central axis A by a support member 49. Support member 49 and rotor 50 may be made of an injection molded Acetal plastic such as that marketed by E. I. DuPont de Nemours & Co. of Wilmington, Delaware under the trade name "Delrin". Rotor 50 is registerable with any one of the plurality of switch actuators or operating tabs that are movable in generally axial directions and is arranged to provide a journal bearing for tiltable actuator arm 3 that is maintained in position by retaining pin 55.

Actuator arm 3 carried by rotor 50 is an elongated unitary member of a rigid material adapted for tiltable mounting on a journal bearing that has a transverse arcuate portion defining a convex and a concave bearing surface substantially at the longitudinal center thereof. The transverse arcuate portion, therefore, is formed to provide a transverse arcuate journal bearing accommodating surface 3*c* extending across the shorter axis of actuator arm 3. To provide rigidity to actuator arm 3, there is an elongated indentation 3*e* and 3*f* on respective opposite sides of the transverse arcuate portion. Actuator arm 3 is of such a dimension in the direction of the diameter of the circle defined by the several individual electrical switch operating tabs that the ends thereof on respective opposite sides of the axis of tilt are in overlapping relationship with all of the individual electrical switch operating tabs. For the reason that will be brought out later in this specification, the overlapping ends of actuator arm 3 are arranged to be in register with each of the individual electrical switch operating tabs at mutually exclusive angular positions. Therefore, the extremities thereof on respective opposite sides of the transverse arcuate portion are circumferentially offset relative to each other in such a manner that actuator arm 3 is in register with each individual electrical switch operating tab at two angular positions, one for each end. Without intention or inference of limitation thereto, actuator arm 3 is indicated to have a switch operating projection 3*a* and 3*b* on respective opposite ends that are circumferentially offset from each other. It is to be specifically understood that any other circumferential offset arrangement for the ends or extremities of actuator arm 3 on opposite sides of the transverse arcuate portion may be employed without departing from the spirit of the invention.

Figure 7:
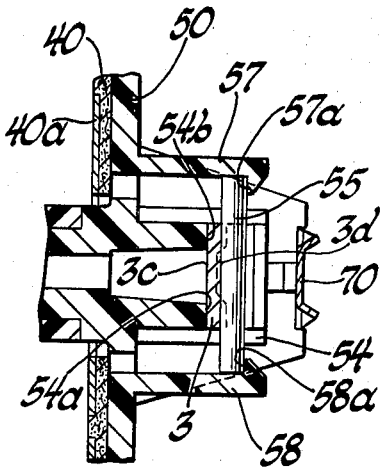
FIG. 7 is a partial section view of FIG. 6 taken along line 7—7 and looking in the direction of the arrows.

Rotor 50 is arranged to carry switch actuator arm 3 that extends across the diameter of the circle defined by the individual electrical switch operating tabs and is of such a dimension as to be in radially overlapping relationship to the individual electrical switch operating tabs. To tiltably mount actuator arm 3 about an axis of tilt substantially normal to central axis A and inboard of the circle defined by the individual electrical switch operating tabs, a stanchion 54 carried by rotor 50 is arranged to provide a journal bearing for actuator arm 3 that is maintained in position by retaining pin 55 disposed within concave bearing surface 3*d* of actuator arm 3 as is best seen in FIGS. 6 and 7. Stanchion 54 is provided with two arcuate journal bearing surfaces 54*a* and 54*b* that are formed to accommodate the convex bearing surface 3*c* of actuator arm 3. Stanchion 54 is substantially centered about and extends substantially in the direction of central axis A and is arranged to provide a journal bearing for actuator arm 3 and to support retaining pin 55 in such a manner that the axis of tilt of actuator arm 3 is substantially normal to and substantially intersects central axis A at a location displaced from rotor 50. The pair of resiliently spreadable retaining pin accommodating members 57 and 58 also carried by rotor 50 extend substantially in the direction of central axis A on opposite sides of stanchion 54 with the respective center lines thereof being aligned with each other along an axis that substantially intersects central axis A. Each of retaining pin accommodating members 57 and 58 has a respective shoulder 57*a* and 58*a* that extends toward central axis A at a location to overlay respective ends of retaining pin 55. As retaining pin accommodating members 57 and 58 are resiliently spreadable, snap-in assembly of retaining pin 55 is provided thereby.

Figure 9:
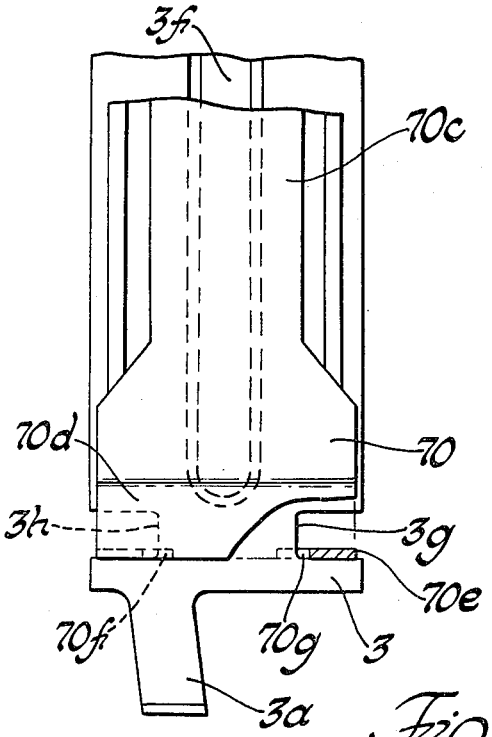
FIG. 9 is a top view partially in break away and partially in section of the portion of FIG. 6 between line 9—9 and looking in the direction of the arrows.
Figure 8:
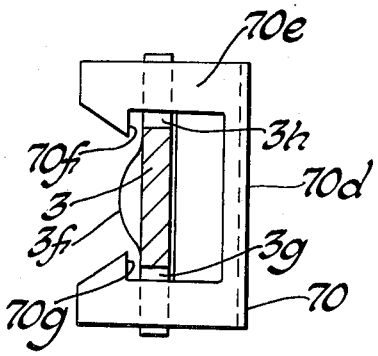
FIG. 8 is a section view of FIG. 6 taken along line 8—8 and looking in the direction of the arrows.

As is best seen in FIG. 6, to tilt actuator arm 3 in a first direction to a first position in which the ends thereof on opposite sides of the axis of tilt normally lie in respective planes substantially parallel to and in bracketing relationship with the previously described common pair of planes in which the individual electrical switch operating tabs lie, a spring 70 is provided. Spring 70 is an elongated unitary spring of a flat spring material characterized by a reverse double arc portion 70*a* at one extremity thereof, a contiguous flat cantilevered section 70*b*, a contiguous intermediate section 70*c* having the parallel edges thereof extending angularly therefrom and a contiguous second reverse double arc section 70*d* at the opposite extremity thereof. The second reverse double arc section 70*d* is formed to provide a terminating portion 70*e* that intersects the plane of the intermediate section 70*c* and has two spaced shoulders 70*f* and 70*g*, FIG. 8, lying in the same plane and extending toward the center line thereof. As is best seen in FIG. 5, 8 and 9, the shoulders 70*f* and 70*g* of terminating portion 70*e* of spring 70 engage accommodating notches 3*g* and 3*h* of actuator arm 3.

To accommodate spring 70, rotor 50 carries another support arrangement such as stanchion 67 that extends substantially in the direction of central axis A and is radially displaced from stanchion 54. Stanchion 67 is arranged to provide a fulcrum 68 for the first reverse double arc portion 70*a* of spring 70 having an axis substantially parallel to and radially displaced from the axis of tilt of actuator arm 3 and lies in a plane displaced therefrom substantially in the direction of central axis A away from rotor 50. Upon the assembly of spring 70, one of the arcs of the reverse double arc portion 70*a* is retained by a member 67*a* formed as a portion of stanchion 67 that has an axis substantially parallel to and radially displaced from that of the fulcrum 68 and lies in a plane displaced therefrom substantially in the direction of central axis A toward rotor 50; the other of the arcs of reverse double arc portion 70*a* is accommodated by fulcrum 68 and the shoulders 70*f* and 70*g* of terminating portion 70*e* engaged the respective notches 3*g* and 3*h* of actuator arm 3. With this arrangement, the normal force of spring 70 is in a counterclockwise direction about fulcrum 68, consequently, as viewing FIG. 6, actuator arm 3 is spring force tilted in a first counterclockwise direction about the axis of tilt by spring 70 to a position in which the ends thereof on opposite sides of the axis of pivot are on the operating side of the several individual electrical switch operating tabs.

To position rotor 50 with one end or the other end of actuator arm 3 on opposite sides of the axis of tilt in register with a selected individual electrical switch operating tab, rotor 50 is connected to the rotor 61 of a step motor 60 that is selectively operable to position rotor 50 in selected ones of a plurality of angular positions in each of which one of the ends of actuator arm 3 is in register with a selected one of the individual electrical switch operating tabs. In this embodiment, the unit selected for step motor 60 is the functional equivalent of a commercially available device marketed by North American Phillips Controls Corporation of Cheshire, Conn. under the designation model number K-82701-T1. Motor 60 may be secured to support member 49 by any suitable fastening arrangement such as a group of tabs, one of which is referenced by the numeral 63, FIG. 1, extending from support member 49 through accommodating openings in motor flange 64.

To tilt actuator arm 3 in a second opposite direction against the force of spring 70 when one of the ends thereof is in register with an individual electrical switch operating tab to engage the operating tab with which the one end of actuator arm 3 is in register to operate the corresponding electrical switch, a solenoid coil 75 having an armature 76 of a magnetic material is employed. Armature 76 may be of a circular cross section having a tapered portion reducing down to an actuating rod 77 that passes through a guide 78 and is in operating engagement with portion 70*c* of spring 70. To reduce noise, a cap 79 of rubber or any other suitable sound deadening material may be installed over the end of armature 76 opposite operating rod 77. Electrical power may be supplied to solenoid coil 75 through input terminals 80 and 81. Solenoid coil 75 may be 440 turns of number 24 copper wire that is so wound that, upon the energization thereof, armature 76 is activated in a direction toward spring 70. Upon the energization of solenoid coil 75, armature 76 is activated in a direction toward spring 70 to tilt actuator arm 3 in a second opposite clockwise direction about the axis of pivot. Referring to FIG. 1, should end 3*b* of actuator arm 3 be in register with operating tab 13*a* of electrical switch 13 upon the tilt of actuator arm 3 in a clockwise direction under the influence of energized solenoid coil 75, end 3*b* thereof operatively engages operating tab 13*a* and moves this tab substantially in the direction of central axis A away from rotor 50 from the position shown by solid lines to the position shown by dashed lines to operate electrical switch 13 out of one operating condition and to establish another operating condition. Should end 3*a* of actuator arm 3 be in register with operating tab 2*a* of electrical switch 2 upon the tilt of actuator arm 3 in a clockwise direction under the influence of energized solenoid coil 75, end 3*a* thereof operatively engages operating tab 2*a* and moves this tab substantially in the direction of central axis A toward rotor 50 from the position shown by solid lines to the position shown by dashed lines to operate switch 2 out of one operating condition and to establish another operating condition.

Figure 2:
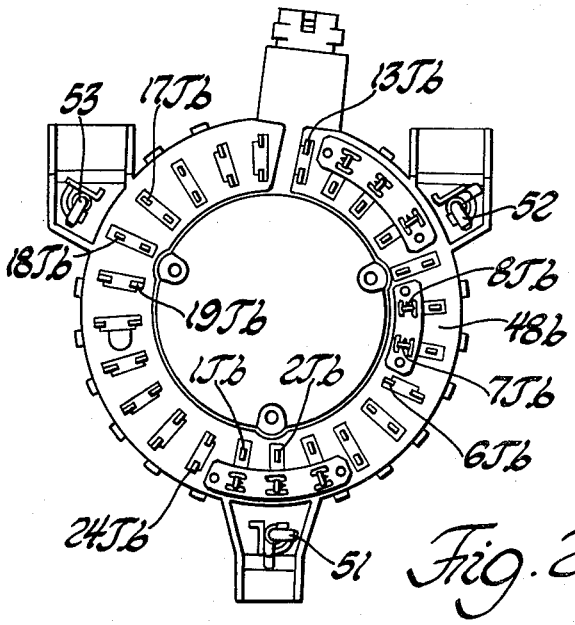
FIG. 2 is a bottom view of FIG. 1 looking in the direction of the arrows 2—2.
Figure 3:
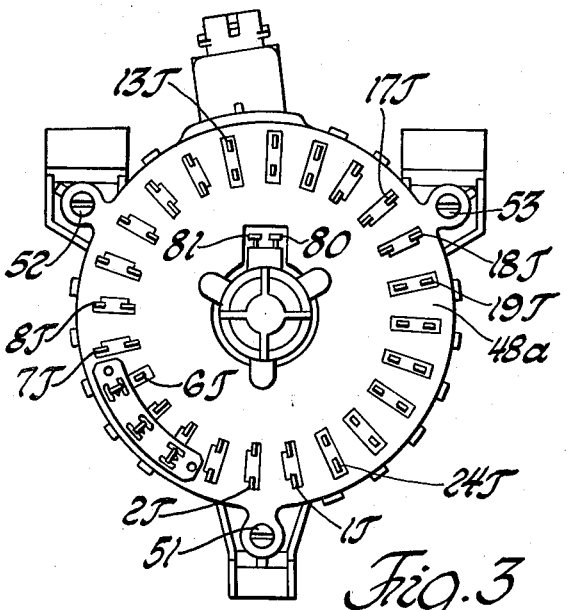
FIG. 3 is a top view of FIG. 1 looking in the direction of the arrows 3—3.

To provide for external electrical connections, each of the individual electrical switches may have two spade-type terminals extending from each opposite end thereof that are arranged to extend through accommodating openings in top portion 48*a* and through accommodating openings in the bottom portion 48*b* of the housing as is best seen in FIGS. 2 and 3. In FIG. 3 of the drawing, ten of these terminal pairs corresponding to individual electrical switches 1, 2, 6, 7, 8, 13, 17, 18, 19 and 24 that extend through accommodating slots in housing portion 48*a* are identified by the respective reference numerals 1T, 2T, 6T, 7T, 8T, 13T, 17T, 18T, 19T and 24T. In FIG. 2 of the drawing, ten of these terminal pairs corresponding to individual electrical switches 1, 2, 5, 6, 7, 13, 17, 18, 19 and 24 that extend through accommodating slots in housing portion 48*b* are identified by respective reference numerals 1T*b*, 2T*b*, 6T*b*, 7T*b*, 8T*b*, 13T*b*, 17T*b*, 18T*b*, 19T*b* and 24T*b*.

As there are twenty-four circumferentially arranged individual electrical load switches in this embodiment and since the ends of actuator arm 3 are arranged to be brought into register with each of the individual electrical switch operating tabs at mutually exclusive angular positions, it is necessary that step motor 60 be arranged to position rotor 50 in each of a plurality of angular positions, hereinafter referred to as switch operating positions, of a number equal to twice the number of individual electrical load switches, forty-eight in this embodiment, with each individual electrical switch operating tab and each space between adjacent operating tabs being a switch operating position. With reference to FIG. 5, it will be assumed for purposes of this specification that end 3*a* of actuator arm 3 is the reference end; that operating tab 1*a* of individual electrical switch 1 is switch operating position number one and that the switch operating positions are numbered sequentially from position number one in a clockwise direction. As individual electrical switch operating tab 1*a* of individual electrical switch 1 is in switch operating position number one and end 3*a* of actuator arm 3 is the reference end thereof, rotor 50 is shown in FIG. 5 to be positioned in switch operating position number two in which end 3*a* of actuator arm 3 is located in the space between adjacent individual electrical switch operating tabs 1*a* and 2*a* of respective individual electrical switches 1 and 2 and end 3*b* of actuator arm 3 is located in register with individual electrical switch operating tab 13*a* of individual electrical switch 13. Upon the energization of solenoid coil 75 with rotor 50 positioned in this switch operating position number two, actuator arm 3 is tilted in a clockwise direction about the axis of pivot and end 3*b* thereof engages and operates individual electrical switch operating tab 13*a* of individual electrical switch 13 substantially in the direction of central axis A away from rotor 50 to establish the selected circuit condition of individual electrical switch 13 to which it is operated by end 3*b* of actuator arm 3. As end 3*a* of actuator arm 3 is located in the space between adjacent individual electrical switch operating tabs 1*a* and 2*a* of respective individual electrical switches 1 and 2, end 3*a* does not engage an individual electrical switch operating tab in this switch position.

With the several switch operating positions numbered as hereinabove set forth, each of the several individual electrical switch operating tabs is in an odd numbered switch operating position and each of the several spaces between each adjacent pair of individual electrical switch operating tabs is in an even numbered switch operating position. To operate any one of the several individual electrical switch operating tabs in a direction toward rotor 50 by end 3*a* of actuator arm 3, rotor 50 is positioned by motor 60 to the odd numbered switch operating position of the operating tab desired to be operated. To operate any one of the several individual electrical switch operating tabs in a direction away from rotor 50 by end 3*b* of actuator arm 3, rotor 50 is positioned by motor 60 to the even numbered switch operating position in which end 3*b* of actuator arm 3 is in register with the operating tab desired to be operated. To illustrate the operation of the remote control unit of this invention, the positioning of rotor 50 to effect the operation of several of the individual electrical switch operating tabs by each end 3*a* and end 3*b* of actuator arm 3 will now be described.

To next position rotor 50 in the switch operating position in which individual electrical switch 19 may be operated to establish the selected circuit condition thereof to which it is operated by end 3*a* of actuator arm 3, rotor 50 is rotated by step motor 60 from switch operating position number two in a clockwise direction through thirty-five switch operating positions or in a counterclockwise direction through thirteen switch operating positions to switch operating position number thirty-seven in which end 3*a* of actuator arm 3 is in register with individual electrical switch operating tab 19*a* of individual electrical switch 19 and end 3*b* is located in the space between adjacent individual electrical switch operating tabs 6*a* and 7*a* of respective individual electrical switches 6 and 7. Upon the energization of solenoid coil 75 with rotor 50 positioned in this switch operating position number thirty-seven, actuator arm 3 is tilted in a clockwise direction about the axis of pivot and end 3*a* thereof engages and operates individual electrical switch operating tab 19*a* of individual electrical switch 19 substantially in the direction of central axis A toward rotor 50 to establish the selected circuit condition of individual electrical switch 19 to which it is operated by end 3*a* of actuator arm 3. As end 3*b* of actuator arm 3 is located in the space between adjacent individual electrical switch operating tabs 6*a* and 7*a* of respective individual electrical switches 6 and 7, end 3*b* does not engage an individual electrical switch operating tab in this switch position.

To next position rotor 50 in the switch operating position in which individual electrical switch 6 may be operated to establish the selected circuit condition thereof to which it is operated by end 3*a* of actuator arm 3, rotor 50 is rotated by step motor 60 from switch operating position number thirty-seven in a clockwise direction through twenty-two switch operating positions or in a counterclockwise direction through twenty-six switch operating positions to switch operating position number eleven in which end 3*a* of actuator arm 3 is in register with individual electrical switch operating tab 6*a* of individual electrical switch 6 and end 3*b* is located in the space between adjacent individual electrical switch operating tabs 17*a* and 18*a* of respective individual electrical switches 17 and 18. Upon the energization of solenoid coil 75 with rotor 50 positioned in this switch operating position number eleven, actuator arm 3 is tilted in a clockwise direction about the axis of pivot and end 3*a* thereof engages and operates individual electrical switch operating tab 6*a* of individual electrical switch 6 substantially in the direction of central axis A toward rotor 50 to establish the selected circuit condition of individual electrical switch 6 to which it is operated by end 3*a* of actuator arm 3. As end 3*b* of actuator arm 3 is located in the space between adjacent individual electrical switch operating tabs 17*a* and 18*a* of respective individual electrical switches 17 and 18, end 3*b* does not engage an individual electrical switch operating tab in this switch position.

To next position rotor 50 in the switch operating position in which individual electrical switch 13 may be operated to establish the selected circuit condition thereof to which it is operated by end 3*a* of actuator arm 3, rotor 50 is rotated by step motor 60 from switch operating position number eleven in a clockwise direction through fourteen switch operating positions or in a counterclockwise direction through thirty-four switch operating positions to switch operating position number twenty-five in which end 3*a* of actuator arm 3 is in register with individual electrical switch operating tab 13*a* of individual electrical switch 13 and end 3*b* is located in the space between adjacent individual electrical switch operating tabs 1*a* and 24*a* of respective individual electrical switches 1 and 24. Upon the energization of solenoid coil 75 with rotor 50 positioned in this switch operating position number twenty-five, actuator arm 3 is tilted in a clockwise direction about the axis of pivot and end 3*a* thereof engages and operates individual electrical switch operating tab 13*a* of individual electrical switch 13 substantially in the direction of central axis A toward rotor 50 to establish the selected circuit condition of individual electrical switch 13 to which it is operated by end 3*a* of actuator arm 3. As end 3*b* of actuator arm 3 is located in the space between adjacent individual electrical switch operating tabs 1*a* and 24*a* of respective individual electrical switches 1 and 24, end 3*b* does not engage an individual electrical switch operating tab in this switch position.

To next position rotor 50 in the switch operating position in which individual electrical switch 19 may be operated to establish the selected circuit condition thereof to which it is operated by end 3*b* of actuator arm 3, rotor 50 is rotated by step motor 60 from switch operating position number twenty-five in a clockwise direction through thirty-seven switch operating positions or in a counterclockwise direction through eleven switch operating positions to switch operating position number fourteen in which end 3*b* of actuator arm 3 is in register with individual electrical switch operating tab 19*a* of individual electrical switch 19 and end 3*a* is located in the space between adjacent individual electrical switch operating tabs 7*a* and 8*a* of respective individual electrical switches 7 and 8. Upon the energization of solenoid coil 75 with rotor 50 positioned in this switch operating position number fourteen, actuator arm 3 is tilted in a clockwise direction about the axis of pivot and end 3*b* thereof engages and operates individual electrical switch operating tab 19*a* of individual electrical switch 19 substantially in the direction of central axis A away from rotor 50 to establish the selected circuit condition of individual electrical switch 19 to which it is operated by end 3*b* of actuator arm 3. As end 3*a* of actuator arm 3 is located in the space between adjacent individual electrical switch operating tabs 7*a* and 8*a* of respective individual electrical switches 7 and 8, end 3*a* does not engage an individual electrical switch operating tab in this switch position.

To next position rotor 50 in the switch operating position in which individual electrical switch 6 may be operated to establish the selected circuit condition thereof to which it is operated by end 3*b* of actuator arm 3, rotor 50 is rotated by step motor 60 from switch operating position number fourteen in a clockwise direction through twenty-two switch operating positions or in a counterclockwise direction through twenty-six switch operating positions to switch operating position number thirty-six in which end 3*b* of actuator arm 3 is in register with individual electrical switch operating tab 6*a* of individual electrical switch 6 and end 3*a* is located in the space between adjacent individual electrical switch operating tabs 18*a* and 19*a* of respective individual electrical switches 18 and 19. Upon the energization of solenoid coil 75 with rotor 50 positioned in this switch operating position number thirty-six, actuator arm 3 is tilted in a clockwise direction about the axis of pivot and end 3*b* thereof engages and operates individual electrical switch operating tab 6*a* of individual electrical switch 6 substantially in the direction of central axis A away from rotor 50 to establish the selected circuit condition of individual electrical switch 6 to which it is operated by end 3*b* of actuator arm 3. As end 3*a* of actuator arm 3 is located in the space between adjacent individual electrical switch operating tabs 18*a* and 19*a* of respective individual electrical switches 18 and 19, end 3*a* does not engage an individual electrical switch operating tab in this switch position.

From this description, it may be noted that (1) end 3*a* of actuator arm 3 is in register with one individual electrical switch operating tab in each of the odd numbered switch operating positions; (2) end 3*b* of actuator arm 3 is in register with one of the individual electrical switch operating tabs in each of the even numbered switch operating positions; and (3) that, depending upon the switch operating position in which rotor 50 is positioned and the next selected switch operating position to which it is to be rotated, there may be a fewer number of switch operating positions to be traversed by clockwise rotor rotation in some instances or by counterclockwise rotor rotation in other instances. Therefore, actuator arm 3 is so located that one of the ends thereof is in register with one individual electrical switch operating tab in each of alternate ones of the switch operating position and the other end thereof is in register with one individual electrical switch operating tab in each of the other alternate ones of the switch operating positions. To save time, it is desirable that the fewer number of switch operating positions be traversed during each repositioning of rotor 50, motor 60 is preferably arranged to be selectively operable to rotate rotor 50 in either direction through a succession of discrete angular or switch operating positions.

Ideally, step motor 60 is digitally controlled by a microprocessor unit such as the MC6802 microprocessor unit marketed by Motorola Semiconductor Products, Inc. of Phoenix, Arizona. In a manner well known in the electronic data processor art, this unit may be programmed to position rotor 50 in response to digital command signals that may be produced by momentary contact electrical switches arranged for manual operation to select each of several different electrical circuit control functions.

To determine whether or not actuator arm 3 is in the switch operating position in which it is in register with the switch operating tab of the electrical load switch selected to be operated, rotor 50 carries a code wheel 40 preferably on the side facing motor 60 as is best seen in FIGS. 1, 4 and 6. Code wheel 40 may be a disc of an insulating material that is arranged to support a conductive pattern 40*a* in a manner well known in the art such as printed circuit techniques. Conductive pattern 40*a* is arranged to have a plurality of concentric tracks, each of which is engaged by a respective sliding contact brush and a common track also engaged by a sliding contact brush through which operating potential is applied to conductive pattern 40*a*. These brushes are best illustrated in FIG. 6 wherein each is referenced by the respective reference numeral 1A, 2A, 3A, 4A, 5A, 6A and 7A. In FIG. 6, brush 7A is illustrated as being in sliding electrical contact with the common concentric track of conductive pattern 40*a* and each of the other brushes is in sliding contact with a respective other concentric track of conductive pattern 40*a*, and each corresponds to a respective bit position of a digital signal representation. Brush 7A may be connected to a source of direct current electrical power, such as an automotive type battery, and each of brushes 1A, 2A, 3A, 4A, 5A and 6A is connected to a point of reference or ground potential through a respective resistor. As a consequence, when any one or more of these brushes is in electrical contact with a conductive portion of conductive pattern A, a digital signal appears across the corresponding resistor and point of reference or ground potential and is applied as a digital input signal to an associated microprocessor unit as is well known in the art. Conductive pattern 40*a* is so arranged that, as rotor 50 is rotated, only one bit of the digital signal representation changes at a time. As a consequence, the output signals from these brushes are not true binary numbers but, rather, are digital signal representations of respective switch operating positions. One example of a code of this type is the familiar gray code well known in the art. As a consequence, as rotor 50 is rotated, a series of digital signal representations of switch operating positions are applied as input signals to the associated microprocessor and are employed thereby in a manner to be later explained in this specification. As there are forty-eight switch operating positions with the embodiments herein described, a six bit digital signal representation is required to have a unique digital signal representation for each switch position. With more or less switch operating positions, digital signal representations of the switch operating positions may require more or less bits, as required. Code wheel 40 provides a feedback signal indicative of actual rotor 50 position to the associated microprocessor.

An example of one application of the switch actuator assembly of this invention is to perform the power switching functions of an automotive vehicle as disclosed and described in detail in each of copending United States patent applications Ser. No. 289,787, filed on Aug. 3, 1981 and Ser. No. 289,464, filed on Aug. 3, 1981 that are assigned to the same assignee as is this invention. The specification and drawing of both of these copending United States patent applications are specifically incorporated by reference in this application.

While a preferred embodiment of the present invention has been shown and described, it will be obvious to those skilled in the art that various modifications and substitutions may be made without departing from the spirit of the invention that is to be limited only within the scope of the appended claims.

The embodiments of the invention in which an exclusive property or privilege is claimed are defined as follows:

1. A rotatable switch actuator assembly comprising:

a rotor supported for rotation about a central axis and registerable with any one of a plurality of fixed switch actuators movable in generally axially directions;

an elongated unitary arm of a rigid material having a transverse arcuate portion defining a convex and a concave arcuate bearing surface substantially at its longitudinal center;

a support means carried by said rotor that is substantially centered about and extends in the direction of said central axis, said support means defining at least one arcuate bearing surface having an axis that substantially intersects said central axis and accommodates said convex bearing surface of said arm whereby said arm is tiltably supported by said rotor about an axis of tilt;

a retaining pin disposed within said concave bearing surface of said arm; and a pair of resiliently spreadable retaining pin accommodating members carried by said rotor extending substantially in the direction of said central axis on opposite sides of said support means, each said retaining pin accommodating member having a shoulder extending toward said central axis at a location to overlay respective ends of a said retaining pin to provide snap-in assembly thereof.

2. A rotatable switch actuator assembly comprising:

a rotor supported for rotation about a central axis and registerable with any one of a plurality of fixed switch actuators movable in generally axially directions;

an elongated unitary arm of a rigid material having a transverse arcuate portion defining a convex and a concave arcuate bearing surface substantially at its longitudinal center;

a support means carried by said rotor that is substantially centered about and extends in the direction of said central axis, said support means defining at least one arcuate bearing surface having an axis that substantially intersects said central axis and accommodates said convex bearing surface of said arm whereby said arm is tiltably supported by said rotor about an axis of tilt;

a retaining pin disposed within said concave bearing surface of said arm;

a pair of resiliently spreadable retaining pin accommodating members carried by said rotor extending substantially in the direction of said central axis on opposite sides of said support means, each said retaining pin accommodating member having a shoulder extending toward said central axis at a location to overlay respective ends of a said retaining pin to provide snap-in assembly thereof; and means carried by said rotor and arranged to tilt said arm in a selected direction about said axis of tilt.

3. A rotatable switch actuator assembly comprising:

a rotor supported for rotation about a central axis and registerable with any one of a plurality of fixed switch actuators movable in generally axially directions;

an elongated unitary arm of a rigid material having a transverse arcuate portion defining a convex and a concave arcuate bearing surface substantially at its longitudinal center;

a support means carried by said rotor that is substantially centered about and extends in the direction of said central axis, said support means defining at least one arcuate bearing surface having an axis that substantially intersects said central axis and accommodates said convex bearing surface of said arm whereby said arm is tiltably supported by said rotor about an axis of tilt;

a retaining pin disposed within said concave bearing surface of said arm;

a pair of resiliently spreadable retaining pin accommodating members carried by said rotor extending substantially in the direction of said central axis on opposite sides of said support means, each said retaining pin accommodating member having a shoulder extending toward said central axis at a location to overlay respective ends of a said retaining pin to provide snap-in assembly thereof; and an elongated unitary spring of a flat spring material characterized by a first reverse double arc section at one extremity thereof; a contiguous flat cantilever section; a contiguous intermediate section having the parallel edges thereof extending angularly therefrom; and a contiguous second reverse double arc section at the opposite extremity thereof formed to provide a terminating portion that intersects the plane of said intermediate section, said terminating portion being provided with two spaced shoulders lying in the same plane and extending toward the center line thereof that are arranged to engage said arm in such a manner that said spring effects the tilt of said arm in a selected direction about said axis of tilt.

4. A rotatable switch actuator assembly comprising:

a rotor supported for rotation about a central axis and registerable with any one of a plurality of fixed switch actuators movable in generally axially directions;

an elongated unitary arm of a rigid material having a transverse arcuate portion defining a convex and a concave bearing surface substantially at the longitudinal center thereof, an elongated indentation on respective opposite sides of said transverse arcuate portion and the extremities thereof on respective opposite sides of said transverse arcuate portion circumferentially offset relative to each other;

a support means carried by said rotor that is substantially centered about and extends in the direction of said central axis, said support means defining at least one arcuate bearing surface having an axis that substantially intersects said central axis and accommodates said convex bearing surface of said arm whereby said arm is tiltably supported by said rotor about an axis of tilt;

a retaining pin disposed within said concave bearing surface of said arm;

a pair of resiliently spreadable retaining pin accommodating members carried by said rotor extending substantially in the direction of said central axis on opposite sides of said support means, each said retaining pin accommodating member having a shoulder extending toward said central axis at a location to overlay respective ends of a said retaining pin to provide snap-in assembly thereof; and means carried by said rotor and arranged to tilt said arm in a selected direction about said axis of tilt.

5. A rotatable switch actuator assembly comprising:

p1 a rotor supported for rotation about a central axis and registerable with any one of a plurality of fixed switch actuators movable in generally axially directions;

an elongated unitary arm of a rigid material having a transverse arcuate portion defining a convex and a concave bearing surface substantially at the longitudinal center thereof and the extremities thereof on respective opposite sides of said transverse arcuate portion circumferentially offset relative to each other;

a support means carried by said rotor that is substantially centered about and extends in the direction of said central axis, said support means defining at least one arcuate bearing surface having an axis that substantially intersects said central axis and accommodates said convex bearing surface of said arm whereby said arm is tiltably supported by said rotor about an axis of tilt;

a retaining pin disposed within said concave bearing surface of said arm;

a pair of resiliently spreadable retaining pin accommodating members carried by said rotor extending substantially in the direction of said central axis on opposite sides of said support means, each said retaining pin accommodating member having a shoulder extending toward said central axis at a location to overlay respective ends of a said retaining pin to provide snap-in assembly thereof;

an elongated unitary spring of a flat spring material characterized by a first reverse double arc section at one extremity thereof; a contiguous flat cantilever section; a contiguous intermediate section having the parallel edges thereof extending angularly therefrom; and a contiguous second reverse double arc section at the opposite extremity thereof formed to provide a terminating portion that intersects the plane of said intermediate section, said terminating portion being provided with two spaced shoulders lying in the same plane and extending toward the center line thereof that are arranged to engage said arm; and a second support means carried by said rotor that extends substantially in the direction of said central axis and is radially displaced from said first support means, said second support means being arranged to provide a fulcrum having an axis substantially parallel with and radially displaced from said axis of tilt of said arm that lies in a plane displaced therefrom substantially in the direction of said central axis and that accommodates one of said arcs of said first reverse double arc section of said elongated unitary spring.

* * * * *